US005121560A

United States Patent [19]

Daane et al.

[11] Patent Number: 5,121,560

[45] Date of Patent: Jun. 16, 1992

[54] APPARATUS AND METHOD FOR COOLING A PRINTED WEB

[75] Inventors: Robert A. Daane; Ralph W. Creapo, both of Green Bay, Wis.

[73] Assignee: Advance Systems, Inc., Green Bay, Wis.

[21] Appl. No.: 630,040

[22] Filed: Dec. 19, 1990

[51] Int. Cl.[5] ..... F26B 7/00

[52] U.S. Cl. ..... 34/13; 34/62; 34/110

[58] Field of Search ..... 34/62, 60, 18, 13, 12, 34/110

[56] References Cited

U.S. PATENT DOCUMENTS

| | | | |
|---|---|---|---|
| 2,157,388 | 5/1939 | MacArthur | 34/13 |
| 2,526,318 | 10/1950 | Battin | 34/62 |
| 2,679,572 | 5/1954 | Workman | 34/110 |
| 3,079,699 | 3/1963 | Fry, Jr. | 34/13 |
| 3,442,211 | 5/1969 | Beacham | 34/13 |
| 3,590,493 | 7/1971 | Gretz | 34/60 |
| 3,714,720 | 2/1973 | Drost et al. | 34/62 |
| 4,077,136 | 3/1978 | Lorrek et al. | 34/13 |
| 4,462,169 | 7/1984 | Daane | 34/62 |
| 4,774,771 | 10/1988 | Littleton | 34/62 |
| 5,036,600 | 8/1991 | Webster et al. | 34/62 |

*Primary Examiner*—Henry A. Bennet
*Assistant Examiner*—Denise L. F. Gromada
*Attorney, Agent, or Firm*—Nilles & Nilles

[57] ABSTRACT

An apparatus and method are disclosed for continuously cooling a hot printed traveling web in order to set the ink thereon. The apparatus and method include a frame and a chill roll rotatably mounted thereon having a peripheral surface. A pressure roll is rotatably mounted on the frame and has a pressure applying surface in contact with the chill roll peripheral surface to define a web receiving nip. The printed web is passed into the nip. Liquid coolant is applied to the peripheral surface of the pressure roll prior to its entering the web nip during which time the pressure roll is cooled. A metering roll is rotatably mounted on the frame to place its peripheral surface in contact with the pressure applying surface to define a metering nip. The pressure in the metering nip is adjusted so that only a predetermined amount of coolant liquid remains on the pressure roll peripheral surface for contact with the web.

19 Claims, 2 Drawing Sheets

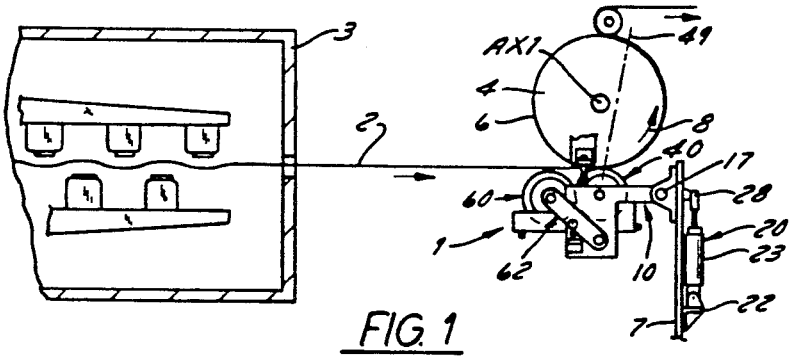
FIG. 1
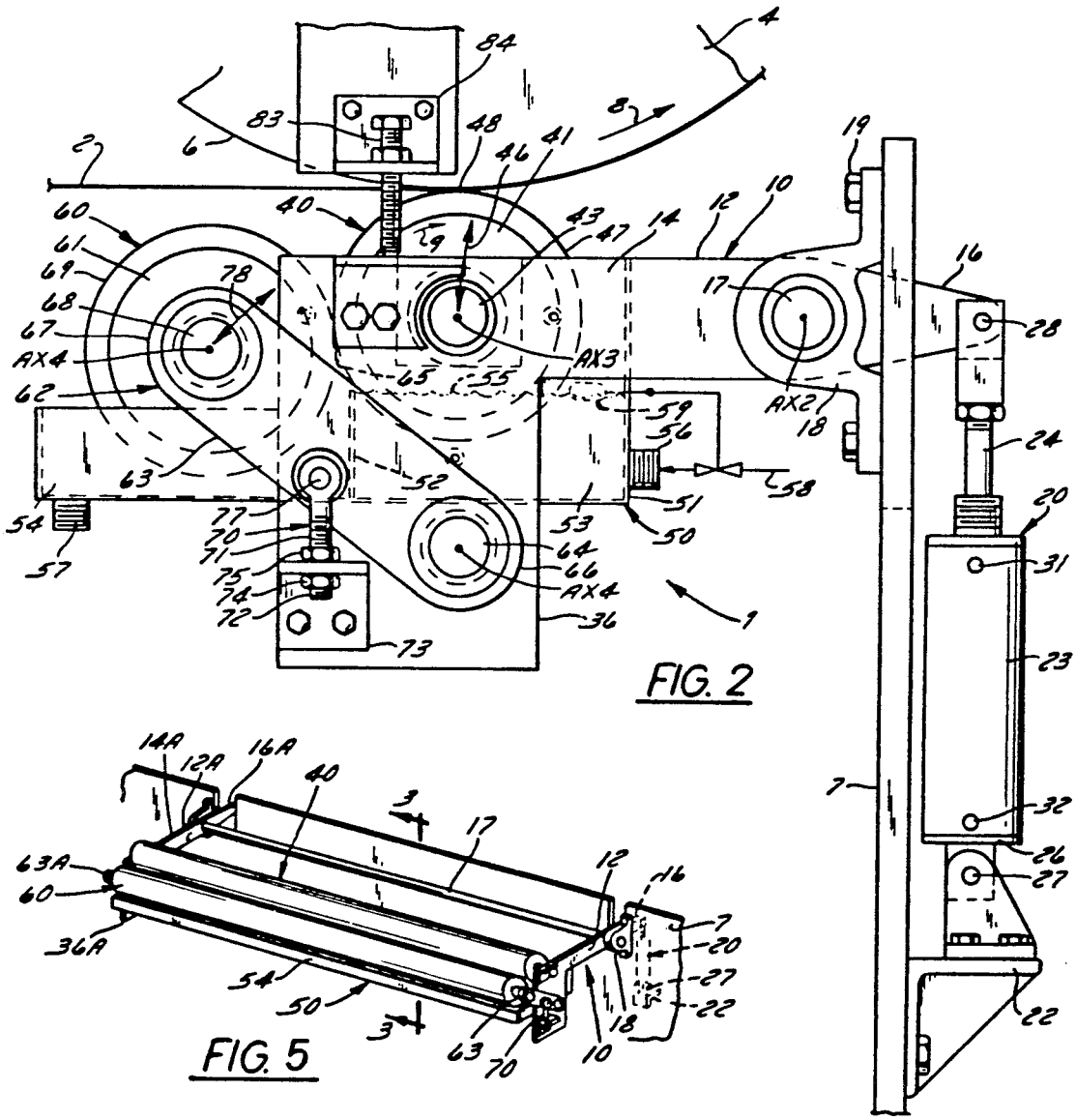
FIG. 2
FIG. 5

APPARATUS AND METHOD FOR COOLING A PRINTED WEB

FIELD OF THE INVENTION

This invention relates to an apparatus and method for continuously cooling a running paper web of indeterminate length and the ink printing thereon after it exits from a dryer.

BACKGROUND OF THE INVENTION

In high-speed offset printing, an endless paper web up to 72" wide at a temperature of about 80° F. is fed through an offset press where it is printed on both sides with a thermoplastic ink and then passed into a dryer. The dryer heats the web to a range 260° F.-380° F. to dry the printing by evaporating the solvents in the ink. The ink is still at the 260° F. to 380° F. temperature when the web leaves the dryer, and because the ink is thermoplastic it remains capable of being deposited on surfaces it may contact until it is "set" by cooling. The depositing of ink is referred to as ink picking and smearing, and it destroys the readability of the printed product. Therefore the web is passed through a chill roll stand having a series of chill rolls where the ink is set by cooling to about 90° F. or less. Offset press speeds of 2000-2500 feet per minute (over 28 miles of printed paper web every hour) are common.

In order to successfully operate an offset press at these high speeds there are a number of interrelated operating parameters that must be met to minimize or avoid problems. Examples of these parameters and problems are: web tension, web weaving (lateral shifting of the web from side to side), moisture content, static electricity, air film between the web and the chill roll, solvent condensation on the chill roll and in the web, and condensate streaking (condensed solvent on the chill roll and in the web redissolving some of the ink back into liquid form which creates ink streaks on the web making the printed product unusable). Frequently the measures taken to adjust one operating parameter to solve one problem exacerbate another problem and therefore the setting of operating parameters has always involved compromising desired standards to a significant extent.

For example, because of the incredibly high speed of the press, the traveling web must be held at high tension to minimize web weaving and lateral shifting of the web from side-to-side and web breakage. In order to maintain proper high tension, the web must be dry and must remain dry; but a dry web has known serious shortcominqs. First, a dry web is more brittle than a moist web and subject to greater likelihood of breakage resulting in press downtime. For example, if the web breaks, in one minute there will be about one-half mile of paper on the pressroom floor. Second, the combination of the dry web and the high-speed travel thereof results in generation of static electricity which makes the web difficult to handle because of clinging. It has long been known that proper moisture will virtually eliminate both breakage and static electricity problems. But experience has taught that moistening of the web is to be avoided because moisture causes even greater problems. For example, moistening of the web causes the paper fibers to expand and such expansion allows the web to stretch resulting in loss of web tension and/or baggy edges to the web. The loss of web tension is highly detrimental as it will allow the web to weave as previously mentioned, and weaving can result in the web breaking unless the weaving can be immediately controlled or stopped. If the weaving cannot be controlled, the press must be shut down and a lengthy, complex start-up procedure followed to restart and recenter the web. Attempts have been made to moisten the web by misting or fogging with water or causing moist air to condense on the chill roll as disclosed in U.S. Pat. No. 2,157,388, issued May 9, 1939 to C. J. MacArthur, but the results have not been satisfactory because of the inability to precisely control the amount of moisture added to the web. Therefore, while moisturizing the web to eliminate brittleness and generation of static electricity is highly desirable, it is avoided to prevent expansion of fibers and consequent loss of web tension.

Another problem is that of efficiently transferring heat from the web to the chill roll. As previously explained, the function of the chill roll is to cool and set the ink after the hot web leaves the dryer. As the speed of the offset press increases, the amount of time a given area of the traveling web is in contact with the chill roll decreases with a consequent decrease in heat transfer time and cooling efficiency. Because of the known problems that arise as a result of moisturizing the web, it is the practice to circulate cooling water internally of the chill roll to avoid directly moisturizing the web. When a specific peripheral area on the chill roll comes into interfacial contact with an opposing area of the web, the cold metal surface of the chill roll will warm up to a higher interface temperature which will be identified as TS and the web surface which faces the metal will in turn cool down to the same temperature TS. The object is to make the temperature TS cool enough to set the ink sufficiently so that it can tolerate the subsequent physical contact of handling rolls downstream of the first chill roll without ink picking and smearing of the print.

The specific value of TS will depend upon the various properties of the chill roll, especially the temperature thereof, the temperature of the web entering the chill roll, and the thermal properties of both the web and the ink thereon such as specific heat, density, and thermal conductivity. The product of these three thermal properties will be termed the index of contact temperature preservation. The higher this index is, the closer the value of TS will be to the oncoming temperature of the material with the high index. On the side of the web which faces the first chill roll (web/chill roll side), this index is quite high because the chill roll is metal which has an inherently high thermal conductivity and density. Therefore there usually is no problem in creating an interfacial temperature TS low enough at the web/chill roll side to set the ink. Unfortunately, the duration of the interfacial contact is so short in a high-speed press that the low cooling temperature created on the web/chill roll side does not have time to penetrate through the web to aid in cooling the ink on the opposite surface of the web thereby resulting in a partially cooled web. Thus the web can leave the chill roll with the ink on the web/chill roll side set while the ink on the opposite side is not set.

There have been many strategies adopted to minimize the partial cooling problem. Obviously the press can be run at a slower speed to increase contact time but this is unacceptable because it increases the cost of production. Improving the intimacy of contact between the web and chill roll helps. When the web wraps around the chill roll, a film of air is trapped between the peripheral surface of the chill roll and the web and this air film acts as an insulator to reduce heat transfer. Improving the intimacy of the web/chill roll side contact by using a pressure roll as taught in U.S. Pat. No. 3,442,211, issued May 6, 1969 to F. W. Beacham, or using an air nozzle on the opposite side of the web, as taught in U.S. Pat. No. 4,369,584, issued Jan. 25, 1983 to Robert A. Daane, is known to help heat transfer but not enough to provide complete cooling.

One obvious solution to the problem would be to water cool both the pressure roll made of metal and the chill roll which is in nip pressure contact with it. Then both rolls will have an outer surface of metal having a high index of contact temperature preservation. However, metals do not deform very much under pressure and therefore it is very difficult to maintain a uniform nip pressure with two mating metal rolls. It is possible to make rolls with sufficient accuracy so that the remaining dimensional inaccuracies can be absorbed by compression of the paper web in the nip but thermal expansion and contraction must also be accounted for. In all known present chill roll designs, the outer chill roll shell is firmly supported only by roll heads at the ends of the roll and the shell is free to thermally expand or contract as dictated by the temperature profile across the web width. If there is a relatively lower temperature of the outer chill roll shell existing locally at some region across the width, that part of the shell will contract to a smaller diameter than will exist in other regions of the shell. This smaller diameter will lead to less nip pressure and still less heating of that part of the shell by the hot paper web. Thus temperature nonuniformity of the chill roll outer shell is self-amplified, leading to serious nonuniform web pressure and nonuniform cooling across the web width. Therefore the use of a metal pressure roll having a high index of contact temperature preservation is not practical.

To avoid the problems arising from using a metal pressure roll, U.S. Pat. No. 3,442,211 teaches the use of an elastomeric pressure roll. While this provides more uniform pressure and avoids distorting the ink, the index of contact temperature preservation for an elastomeric pressure roll is very low and not effective for cooling the opposite side of the web which it contacts. In operation the elastomeric surface immediately becomes hot and does not cool and set the ink. Instead the pressure roll will pick and smear the ink to destroy the readability of the print. U.S. Pat. No. 3,442,211 recognizes the ink picking problem and to avoid it teaches that the pressure roll be covered with an ink resistant material such as a silicone compound or a synthetic plastic such as "Teflon". However, such coatings also have a low index of contact temperature preservation and will not efficiently cool and set the ink, especially as the speed of the press increases. Thus efficient cooling of the unset ink, especially on both sides of the web in high-speed printing, remains a significant unsolved problem.

Another long-known problem is that of condensation of vaporized ink solvent and condensate streaking. When a hot printed web emerges from the dryer and approaches the first chill roll, residual ink solvent evaporates from the hot web surfaces. The vaporized solvent contacts and condenses on the relatively cold chill roll surface. The colder the roll the greater the condensation problem. As mentioned above, there is an inherent tendency for a film of air to be carried between the web and the cylindrical surface of the chill roll and be trapped therein thus preventing the desired intimate contact. The condensation can collect and build up in this air film space. If the web can wrap the chill roll with close intimate contact, the volume of this film of air can almost be eliminated. Consequently, the amount of condensate therein will be small and immediately reabsorbed by the web in such small amounts that the solvent will have no effect on the ink print because there is no room between the web and the chill roll surface for condensate to accumulate. If, however, the air film volume is larger, larger amounts of condensate can accumulate in this space and be reabsorbed in intermittent concentrated amounts sufficient to redissolve the ink and cause condensate streaking which ruins the printing.

While it is known that maximizing this intimate contact between web and chill roll will minimize condensate streaking, as discussed in U.S. Pat. No. 3,442,211, the prior art does not teach how this can be accomplished while also simultaneously maximizing the cooling and consequent setting of the ink on both sides of the web. The use of a metal pressure roll is not possible because of pressure distortion of the unset ink. The use of an elastomeric pressure roll has not been satisfactory because it has such a low index of contact temperature prevention that it does not efficiently cool the ink. Prior art teaches away from the use of water for directly cooling the web because it expands the fibers and causes loss of web tension. As a result of the above discussed problems, the prior art cooling apparatus and methods do not lower the temperature of the web and print as much as desired and require the use of a higher number of chill rolls than desired in the cooling zone of the press, and this increases both capital costs and servicing expenses. Even with these added chill rolls, uneven cooling across the web width exists and condensate streaking, ink picking and smearing remain unsolved problems.

SUMMARY OF THE INVENTION

The object of the invention is to cool the hot web and the soft thermoplastic ink thereon more efficiently than has been possible in the prior art without causing condensate streaking. To accomplish cooling of the web and ink, the web is pressed against the chill roll using a pressure roll having an elastomeric cover to apply uniform pressure. The outside peripheral elastomeric peripheral surface which contacts the web is cooled by running it through a reservoir of coolant and the amount of coolant remaining on the elastomeric surface is precisely metered to a predetermined amount to prevent excess coolant from going into the web.

In accordance with the invention there is provided an apparatus for continually cooling a hot web of indeterminate length having unset thermoplastic ink printing thereon that is moving in one direction of travel in order to set the ink. The apparatus includes a frame means and a chill roll which has a peripheral surface. The chill roll is mounted on the frame means to move the peripheral surface thereof in the one direction of web travel. The apparatus also includes a pressure applying means having a pressure applying surface. The pressure applying means is mounted on the frame to present the pressure applying surface in confronting relation to the peripheral surface of the chill roll to define a nip for receiving the hot printed web therebetween during operation. The pressure applying means is mounted so as to permit the pressure applying surface thereof to move in the same direction of travel at the nip as the direction of travel of the chill roll peripheral surface. The apparatus also includes a cooling means for cooling the pressure applying surface with a liquid coolant prior to the pressure applying surface passing into said nip and for limiting the liquid coolant that will remain on said pressure applying surface to a predetermined amount. Preferably the pressure applying means includes a pressure roll rotatably mounted on the frame and the pressure applying surface is an elastomeric surface on the pressure roll which is in compressive engagement with the chill roll peripheral surface. The cooling means may further include a coolant metering means that has a metering surface in contact with the pressure applying surface to precisely control the amount of liquid coolant which remains thereon to reach the web nip during operation. The metering means may comprise a metering roll mounted for rotation on the frame means to present the metering surface in the aforementioned confronting relation to the elastomeric surface of the pressure roll to define a metering nip therebetween wherein the metering surface will move in the same direction of travel at the metering nip as the direction of travel of the elastomeric surface at the metering nip.

Preferably the cooling means will also include a reservoir which contains a cooling liquid with the pressure roll rotatably mounted on the frame in a position so that the pressure applying surface thereon will first move through the cooling liquid in the reservoir and then into the web nip. The metering roll may be mounted for rotation on the frame to place the metering surface thereof in contact with the elastomeric surface after it exits from the reservoir and prior to the elastomeric surface entering into the web nip in order to remove excess cooling liquid from the elastomeric surface and to control the amount of cooling liquid remaining thereon to the predetermined amount. Preferably the reservoir will include a cooling liquid reservoir and a separate overflow reservoir with the pressure roll being mounted to pass the elastomeric surface thereof through the cooling liquid reservoir and the metering roll mounted to direct the excess cooling liquid which is removed from the elastomeric surface into the overflow reservoir.

The apparatus will also include a first support means that is mounted on the frame for movement toward and away from the chill roll peripheral surface with the pressure applying means being mounted on the first support means. A first adjusting means may be provided for selectively moving the first support means toward and away from the chill roll to adjust the contact pressure between the chill roll and elastomeric surfaces in the web nip. A second support means may be mounted on the first support means for movement toward and away from the pressure roll with the metering roll being rotatably mounted on the second support means to present a metering surface in confronting relation to the elastomeric surface of the pressure roll to define the metering nip therebetween. A second adjusting means may be mounted between the first support means and the second support means to move the metering roll toward and away from the pressure roll to adjust the clearance in the metering nip to precisely control the amount of liquid coolant which remains on the elastomeric surface after it leaves the metering nip. The liquid coolant reservoir and the overflow reservoir both may be mounted on the first support means so as to move therewith toward and away from the chill roll. A liquid coolant supply means may be provided for continuously supplying cooling liquid to the liquid coolant reservoir through an inlet and for removing spent liquid coolant through an outlet in the reservoir.

According to another aspect of the invention, a method is disclosed for continuously cooling a hot traveling web having unset thermoplastic ink printing on one or both sides thereof in order to set the ink. The method comprises the steps of providing a chill roll having a peripheral surface and rotating said chill roll to move the peripheral surface in one direction of travel; providing a pressure applying means having an elastomeric surface; placing the elastomeric surface in confronting relation to said chill roll peripheral surface to define a web nip for receiving said hot printed web therebetween and moving the elastomeric surface in the one direction of travel; passing the hot printed web into the web nip and causing one side of the web to contact the chill roll peripheral surface and causing the other side of the web to contact the elastomeric surface; continuously cooling the elastomeric surface by applying a liquid coolant thereto to establish a cooled elastomeric surface having a predetermined amount of liquid coolant remaining thereon prior to its coming into contact with the web nip; and causing said cooled elastomeric surface to enter said web nip and to contact, cool and set the ink. The method may comprise the further steps of providing a liquid coolant metering means presenting a metering surface in position to confront the elastomeric surface after the liquid coolant has been applied thereto, and moving the metering surface toward or away from the coolant coated elastomeric surface to control the amount of coolant liquid remaining on the elastomeric surface at it comes into said web nip. Preferably the pressure applying means will be movable toward and away from the chill roll peripheral surface and the pressure applying means will be adjusted to move the elastomeric surface into contact with the chill roll peripheral surface until the elastomeric surface has deformed sufficiently to provide an interface contact area between the surfaces.

BRIEF DESCRIPTION OF THE DRAWINGS

Referring to the drawings:

FIG. 1 is a diagrammatic view showing the cooling apparatus of the present invention receiving the printed web after it exits from a dryer;

FIG. 2 is an enlarged side elevational view of the cooling apparatus shown in FIG. 1;

FIG. 5 is a partial isometric projection view of the cooling apparatus showing FIG. 2, but on a reduced scale.

DESCRIPTION OF THE PREFERRED EMBODIMENTS

Referring to FIG. 1, the cooling apparatus 1 is shown receiving the hot printed paper web 2 after it exits from dryer 3. The web will have a dryer exit temperature as high as 380° and will be traveling at a speed that may be as high as 2000 to 2500 feet per minute. The web 2 will have ink printing on one or both sides and the ink at the above described temperature will be thermoplastic and thus capable of transferring to any surface with which it comes into contact. A single cooling apparatus 1 is shown incorporating a single chill roll 4 but it is to be understood that the cooling apparatus may comprise a chill roll stand having a plurality of cooling apparatuses around which the hot web sequentially passes for the purpose of providing a finally cooled web having a temperature of 90° F. or lower which sets the thermoplastic ink thereon. The number of chill rolls incorporated into the stand will depend on the temperature of the web, its speed of travel, and the efficiency of the chill rolls to cool the web. With the present invention the number of chill rolls in a stand can be reduced or the speed of the press increased without resulting in unset ink on the web leaving the chill roll stand.

Figure 3:
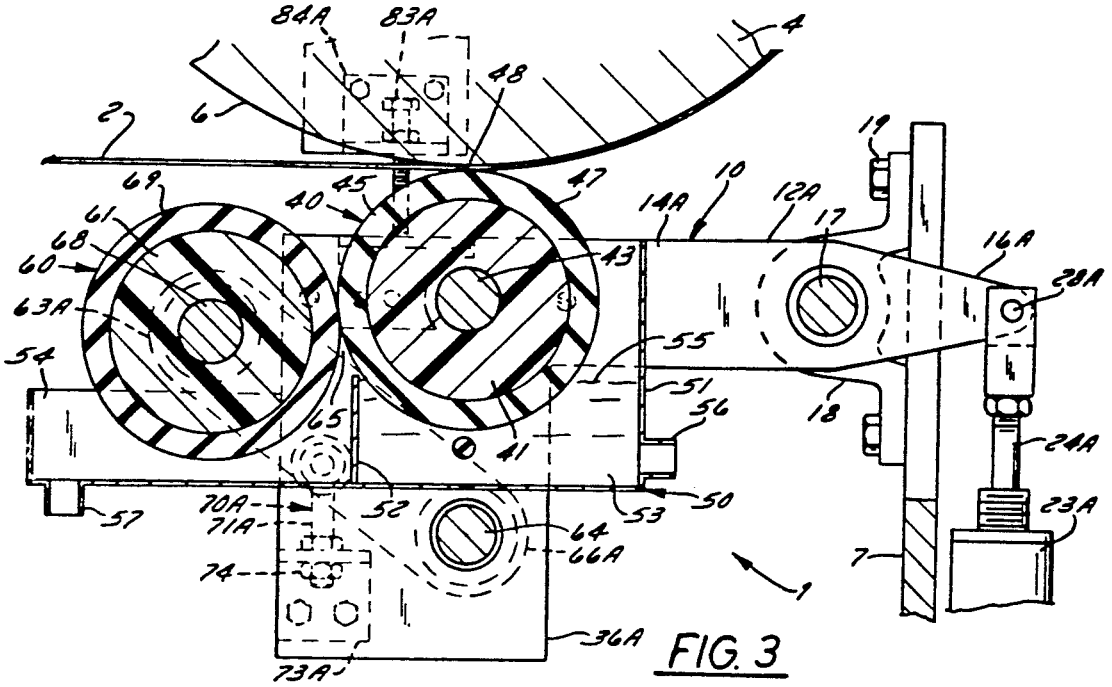
FIG. 3 is a partial section taken generally along line 3—3 of FIG. 5, but on an enlarged scale.

Referring to FIGS. 2, 3 and 5, the cooling apparatus 1 includes a frame means 7 on which the chill roll 4 is mounted for rotation about an axis AX1 in the direction of arrow 8. A first support means 10 is mounted on the frame 7 for pivotal movement toward and away from the peripheral surface 6 of chill roll 4 in the direction of arrow 46. The first support means 10 comprises a pair of transversely spaced apart first lever arms 12 and 12A. As lever arms 12 and 12A are identical in construction, only the first lever arm 12 shown in FIG. 2 will be described. The first lever arm 12 has inner and outer ends 14 and 16 and a journal means in the form of a pivot shaft 17 intermediate the inner and outer ends. A pillow block 18 is secured to the frame means 7 by bolts 19 and rotatably supports the shaft 17 therein for pivotal movement about a pivot axis AX2. The inner end 14 of the first lever arm 12 extends away from the journal block 18 in one direction toward and below the chill roll 4 and the outer end 16 of the first lever arm 12 extends away from the pillow block 18 in the opposite direction.

A first adjusting means 20 is mounted between the frame 7 and the outer end 16 of the first lever arm 12. The first adjusting means includes a bracket assembly 22 mounted on frame means 7 and a servomotor such as a double-acting extensible and contractible pneumatic or hydraulic ram 23 having a piston end 24 and a cylinder end 26. The cylinder end 26 of the ram 23 is connected to the bracket assembly 22 by a pivot pin 27. The piston end 24 of the ram 23 is similarly connected to the outer end 16 of the first lever arm 12 by means of pin 28. A suitable conventional source of pneumatic or hydraulic pressure, not shown, is connected to piston and cylinder ports 31, 32 of ram 23 and is controlled by conventional valve means to cause the expansion and contraction thereof. Contraction and expansion of the ram 23 will pivot lever 12 and move the inner end 14 closer or farther away from the peripheral surface 6 of the chill roll 4, as will be more fully discussed hereinafter. The first adjusting means 20 also includes a similar ram 23A at the other side of the cooling apparatus as shown in FIG. 3 and these components will not be further described as they are constructed, mounted on frame 7 and operated in the same manner as bracket 22 and ram 23 shown in FIG. 2.

The inner ends 14, 14A of the first lever arms 12, 12A further include a pair of transversely spaced apart side plates 36, 36A which are, as shown in FIGS. 2, 3 and 5, integral with the inner ends 14, 14A of the first lever arms 12 and 12A. The side plates 36 and 36A are identical in construction. Preferably the side plate 36 will be formed integrally with the first lever arm 12 and depend downwardly therefrom. The purpose of the side plates 36, 36A is to provide a structure on which a pressure applying means 40 and a coolant applying means 50 can be mounted, as will now be described.

The pressure applying means 40 includes a transversely extending pressure roll 41 which subtends the chill roll 4. The pressure roll 41 is rotatably mounted on bearings, not shown, carried by a shaft 43 for rotation about axis AX3. The outer ends of shaft 43 are secured to side plates 36, 36A on the first lever arms 12 and 12A, respectively, by means of support blocks 42, 42A suitably secured to side plates 36, 36A. If desired, the pressure roll support shaft 43 could be rotatably mounted in suitable bearings in the bearing blocks on side plates 36, 36A. The pressure roll 41 has a pressure applying surface 47 presented by an outer layer of elastomeric material 45 such as rubber. Preferably the elastomeric layer 47 will have a hardness of about 30 durometer. The pressure roll 41 is mounted to present the pressure applying surface 47 in confronting contact with the chill roll peripheral surface 6 to define a web nip 48 for receiving the web 2 during operation. As shown in FIG. 1, the contact point of the cooling roll web nip 48 is on a tangent 49 relative to chill roll axis AX1 to improve web wrapping on the chill roll 4. The chill roll peripheral surface 6 moves in one direction of travel as shown by arrow 8 and the friction contact through web 2 with pressure roll 41 will cause the elastomeric surface 47 to move in this same direction of travel at the nip as indicated by arrow 9.

A cooling means 50 for cooling the pressure applying surface 47 is also mounted on side plates 36, 36A and will now be described. The coolant applying means 50, best shown in FIG. 3, includes a reservoir 51 extending transversely of the chill roll 4 in subtending relation thereto. The reservoir 51 is provided with a vertical partition 52 which divides the reservoir into a cooling liquid reservoir 53 and an overflow reservoir 54. The reservoir 51 is also provided with coolant liquid inlet 56 and outlet 57. A source 58 of coolant liquid, preferably water, is connected by conventional float control valve assembly 59 to assure that reservoir 53 is full of cool water 55 during operation. The reservoir 51 may be secured between the side plates 36, 37 by any suitable fastening means such as by bolting, riveting or welding.

The cooling means 50 further comprises a coolant metering means 60 which includes a metering roll 61. The metering roll 61 is rotatably supported on a second support means 62 comprising transversely spaced apart second lever member arms 63, 63A carried by transverse shaft 64 which is rotatably supported by side plates 36, 36A for rotation about an axis AX4. The second lever arms 63, 63A have support ends 66, 66A fixedly mounted on shaft 64 and free ends 67, 67A. The metering roll 61 is rotatably mounted on a transverse shaft 68, the ends of which are mounted in the free ends 67, 67A of the second lever arms 63, 63A. The metering roll 61 is provided with a resilient peripheral surface 69 such as rubber. Roll 61 is positioned over the overflow reservoir 54 so that the peripheral surface 69 will be carried through the reservoir during operation, as will be more fully described hereinafter. A second adjusting means 70, 70A is mounted between plates 36, 36A on the inner ends 14, 14A of the first lever arms 12, 12A and an intermediate portion of the second lever arm 63, 63A. As the second adjusting means 70, 70A are identical, only adjusting means 70 will be described. The second adjusting means 70 includes a bolt 71 having a threaded portion 72 which passes through an aperture in bracket 73 bolted onto side plate 36. Adjusting nuts 74, 75 are threaded onto threaded portion 72 on opposite sides of the bracket 73. The other end of the bolt 71 has a universal swivel connection 77 secured to the intermediate portion of the second lever arm 63. Movement adjusting of nuts 74, 75 will extend or contract bolt 71 and pivot the second lever arm about axis AX4 in the direction shown by arrow 78 in FIGS. 2 and 4.

The cooling apparatus 1 as above described is movable as a complete unit toward and away from the chill roll peripheral surface by pivoting about axis AX2. Contraction of rams 23, 23A will cause the inner ends 14, 14A to move upward and cause the pressure roll 41 to move towards the chill roll in the direction of arrow 46 until it contacts the peripheral surface 6 of the chill roll 4. The ram will be caused to exert an amount of pressure sufficient to create a nip interface contact area between the pressure roll elastomeric surface and the chill roll peripheral surface 6 that is of some width depending on the roll diameters, elastomeric cover material, and pressure exerter. The cooling apparatus 1 is provided with an adjustable stop means in the form of a stop bolt 83 threaded into a tapped aperture of a mounting bracket 84 as shown in FIG. 2. The stop bolt 83 is adjusted to contact a stop bracket 86 carried on the inner end of first lever arm 12 and prevent further movement thereof when the desired width of inner face contact area has been achieved.

Figure 4:
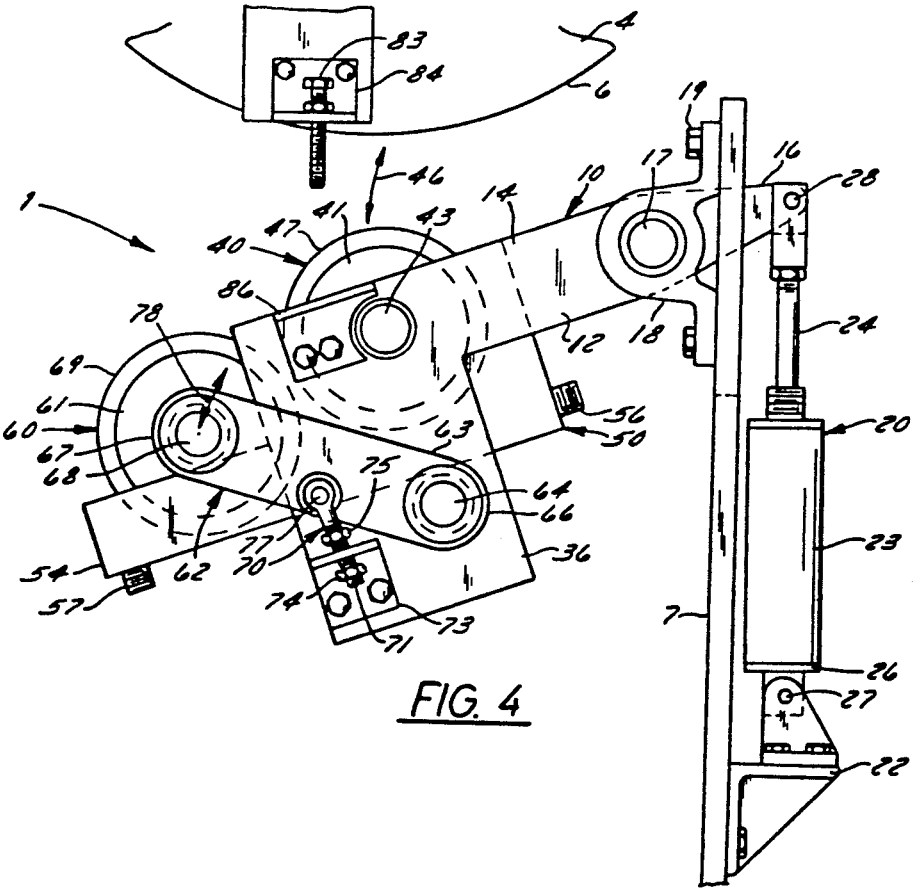
FIG. 4 is a side elevation similar to FIG. 2 showing the cooling apparatus in a service position.

For the purposes of servicing, the first adjusting means 20 can be actuated to move the cooling apparatus 1 to the position shown in FIG. 4 wherein the pressure roll 41 is out of contact with the chill roll 4. In this position the components of the cooling apparatus are exposed for convenient service work.

METHOD

The present invention also provides a method for continuously cooling the hot traveling web 2 and the thermoplastic ink printing thereon. To perform the method, the chill roll 4 is rotated in order to move the chill roll peripheral surface 6 in one direction as indicated by arrow 8. The first adjusting means 20 is adjusted to place the elastomeric surface 47 in abutting relation to the chill roll surface to define a web nip 48 for receiving the hot printed web 2 therebetween. The hot printed web is passed into the web nip causing one side of the web to contact the chill roll peripheral surface 6 and causing the other side of the web to contact the elastomeric surface 47. The elastomeric surface of the pressure roll 41 is cooled by running it through a liquid coolant 55, such as water, in a pan 51 prior to its coming into contact with the web nip 48. The coolant metering means 60 is adjusted to place the metering surface 69 thereof in confronting contact with the elastomeric surface 47 of the pressure roll to define a metering nip 65. The second adjusting means 70 is adjusted to move the metering surface 69 toward or away from the coolant coated elastomeric surface 47 in order to control the amount of coolant liquid which remains on the elastomeric surface as it comes into the web nip 78. By adjusting the contact pressure between the metering surface 69 and the elastomeric surface 47 at coolant nip 65, the removal of cooling liquid 55 from the latter can be minutely controlled. Preferably enough pressure will be exerted so that the elastic surface 47, after it leaves contact with the metering roll surface 69, will only be slightly damp before contacting the web 2. The phrase "slightly damp" means the amount of cooling liquid remaining on the elastomeric surface will be a sufficient amount to moisten it sufficiently to reduce formation of static electricity, but not in such quantity as will cause sufficient expansion of the web fibers to allow web elongation and loss of web tension.

In one example of the method, the pressure roll 41 and the metering roll 61 were mounted to freely rotate with the pressure roll 41 being rotated in the direction of arrow 9 as a result of its contact with the moving web 2. The rotation of the pressure roll 41 in turn caused rotation of the metering roll 61 by reason of the contact between these two rolls. Ram 23 was adjusted to move the elastomeric surface 47 into contact with the chill roll surface 6 and to form an interface contact of ⅛" to ⅜" width. Cooling liquid in the form of water 55 was passed through the reservoir 51 and maintained at a temperature in the range of 65° F. to 70° F. The pressure roll elastomeric surface 47 was caused to pass through the liquid coolant in the reservoir and then into contact with the metering surface 69 of the metering roll 61. Adjusting bolt 71 was adjusted to cause sufficient pressure to be applied in the metering nip 65 between metering roll 61 and pressure roll 41 to cause the removal of cooling liquid from the elastomeric surface to the degree that the elastomeric surface was only slightly damp before contacting the web. The temperature of web 2 entering web nip 48 was 242° F. And the temperature of the web leaving chill roll 4 was about 118° F. Adding moisture to the web as above-described enabled the first chill roll 4 to cool the web 28° F. more than has been possible with previous methods. The trace of moisture imparted to the web eliminated static buildup but did not add sufficient moisture to expand the paper fibers to the degree that they permitted stretching and loss of web tension. The elastomeric surface was not subject to ink picking and the printed surface was not subject to smearing.

What is claimed is:

1. An apparatus for continuously cooling a hot web of indeterminate length having unset thermoplastic ink printing thereon that is moving in one direction of travel, in order to set said ink comprising:

a frame means;

a chill roll having a peripheral surface adapted to contact said web during operation, said chill roll mounted on said frame means to move said peripheral surface in said one direction of travel;

a pressure applying means having a pressure applying exterior surface, said pressure applying means mounted on said frame means to present said pressure applying exterior surface in contact with said chill roll peripheral surface to define a web nip for receiving said web therebetween during operation, and to move said pressure applying surface in the same direction of travel at said web nip as said one direction of travel; and a cooling means for applying a liquid coolant to said pressure applying exterior surface prior to said exterior pressure applying surface contacting said web upstream of said web nip for limiting the amount of liquid coolant that will remain on said pressure applying exterior surface as it enters said web nip to a predetermined amount.

2. The apparatus according to claim 1 wherein said pressure applying means includes a pressure roll rotatably mounted on said frame, and said pressure applying exterior surface is an elastomeric surface on said pressure roll in compressive engagement with said chill roll peripheral surface.

3. The apparatus according to claim 1 wherein said cooling means includes a coolant metering means having a metering surface, said metering means mounted on said frame means to present said metering surface in contact with said pressure applying exterior surface to control the amount of liquid coolant which remains thereon to reach said web nip during operation.

4. The apparatus according to claim 3 wherein said metering means comprises a metering roll mounted for rotation on said frame means to present said metering surface in contacting relation to said elastomeric surface to define a metering nip therebetween, and to move said metering surface in the same direction of travel at said metering nip as said direction of travel of said elastomeric surface at said metering nip.

5. The apparatus according to claim 1 wherein:

said cooling means includes a reservoir for cooling liquid; and said pressure applying means includes a pressure roll mounted on said frame for rotation relative thereto with said pressure applying exterior surface thereon comprising an elastomeric surface, said direction of travel of said pressure roll causing said elastomeric surface to first move through said cooling liquid in said reservoir and then into said web nip.

6. The apparatus according to claim 5 wherein said cooling means further includes a metering roll having a metering surface, said metering roll mounted for rotation on said frame to place said metering surface in contact with said elastomeric surface after it exits from said reservoir and prior to said elastomeric surface entering said web nip to remove excess cooling liquid from said elastomeric surface to control the amount of cooling liquid remaining thereon as it passes into said web nip.

7. The apparatus according to claim 6 wherein:

said reservoir includes a cooling liquid reservoir and an overflow reservoir;

said pressure roll is mounted to pass said elastomeric surface through said cooling liquid reservoir; and said metering roll is mounted to direct said excess cooling liquid removed from said elastomeric surface into said overflow reservoir.

8. An apparatus for continuously cooling a hot web of indeterminate length having unset thermoplastic ink printing thereon, that is moving in one direction of travel, in order to set said ink comprising:

a frame means;

a first support means mounted on said frame for movement toward and away from said chill roll peripheral surface;

a chill roll having a peripheral surface adapted to contact said web during operation, said chill roll rotatably mounted on said first support means to provide for movement of said peripheral surface in said one direction of travel;

a pressure applying means mounted on said first support means and having a peripheral exterior elastomeric surface in contact with said chill roll peripheral surface to define a web nip therebetween, said pressure applying means moving said exterior elastomeric surface in the same direction of travel as said one direction of travel at said web nip;

a cooling means is mounted on said first support means for applying a liquid coolant to said exterior elastomeric surface prior to said exterior elastomeric surface contacting said web upstream of said web nip, and limiting the liquid coolant remaining thereon to a predetermined amount; and a first adjusting means mounted between said frame and first support means for selectively moving said first support means toward and away from said chill roll to adjust the contact pressure between the chill roll and exterior elastomeric surfaces in said web nip.

9. The apparatus according to claim 8 wherein:

said pressure applying means includes a pressure roll rotatably mounted on said first support means;

a second support means is mounted on said first support means for movement toward and away from said pressure roll;

said cooling means includes a metering roll rotatably mounted on said second support means having a metering surface in confronting relation to said exterior elastomeric surface of said pressure roll to define a metering nip therebetween; and a second adjusting means is mounted between said first support means and second support means to move said metering roll toward and away from said pressure roll to adjust the pressure in said metering nip between said metering surface and said exterior elastomeric surface and control the amount of liquid coolant remaining thereon.

10. The apparatus according to claim 9 wherein:

said cooling means includes a reservoir for holding a liquid coolant that is mounted on said first support means with said pressure roll mounted so that rotation thereof will carry said exterior elastomeric surface through said reservoir of liquid coolant.

11. The apparatus according to claim 10 wherein:

said reservoir comprises a coolant reservoir and an overflow reservoir, both of which are mounted on said first support means;

said pressure roll is mounted on said first support to carry said exterior elastomeric surface through said coolant reservoir; and said metering roll is mounted on said second support to carry said metering surface through said overflow reservoir prior to said metering surface coming into contact with said exterior elastomeric surface.

12. The apparatus according to claim 10 wherein said reservoir has a liquid coolant inlet and a liquid coolant outlet; and a liquid coolant supply means for circulating cooling liquid through said reservoir.

13. The apparatus according to claim 10 wherein:

said first support means includes a first lever arm means having inner and outer ends, a journal means on said first lever arm means intermediate said ends, and a pillow block on said frame means for supporting said journal means therein;

said pressure roll, second support means and reservoir being mounted on said inner end of said first lever arm means; and said first adjusting means mounted between said frame means and said outer end of said first lever arm means.

14. The apparatus according to claim 13 wherein said first adjusting means comprises an extensible and contractible servomotor.

15. The apparatus according to claim 13 wherein:

said second support means comprises a second lever arm structure having spaced apart support and free ends;

said support end being rotatably mounted on said first lever arm means;

said metering roll being rotatably mounted on said free end of the second lever arm structure; and said second adjusting means being mounted between said inner end of the first lever arm means and said second lever arm.

16. The apparatus according to claim 10 wherein an adjustable stop means is mounted on said frame means to index the position of said first support means and control the amount of pressure said exterior elastomeric surface exerts on said chill roll peripheral surface.

17. A method for continuously cooling a hot web of indeterminate length having unset thermoplastic ink printing on one or both sides thereof that is moving in one direction of travel, in order to set said ink comprising the steps of:

A) providing a rotatable chill roll having a peripheral surface and rotating said chill roll to move said peripheral surface in said one direction of travel;

B) providing a pressure applying means having an exterior elastomeric surface, placing said exterior elastomeric surface in contact with said chill roll peripheral surface to define a web nip for receiving said hot printed web therebetween and moving said exterior elastomeric surface in said one direction of travel;

C) passing said hot printed web into said web nip and causing one side of said web to contact said chill roll peripheral surface an causing the other side of said web to contact said exterior elastomeric surface;

D) continuously cooling said exterior elastomeric surface by applying a liquid coolant thereto prior to said exterior elastomeric surface coming into contact with said web nip and limiting the amount of liquid coolant remaining thereon to a predetermined amount to establish an exterior elastomeric surface cooled by liquid coolant retained thereon; and E) causing said liquid retaining exterior elastomeric surface to enter said web nip and contact said web to cool and set said ink thereon.

18. The method according to claim 17 comprising the further steps of:

F) providing a liquid coolant metering means having a metering surface, placing said metering surface in contact with said exterior elastomeric surface to define a metering nip positioned downstream from the point where said liquid coolant has been applied to said exterior elastomeric surface; and G) moving said metering surface toward or away from said coolant coated exterior elastomeric surface to control the pressure in said metering nip and thereby regulate the amount of coolant liquid remaining on said exterior elastomeric surface as it comes into said web nip.

19. The method according to claim 18 comprising the further steps of:

H) mounting said pressure applying means to be movable toward and away from said chill roll peripheral surface; and I) moving said pressure applying means to move said exterior elastomeric surface into contact with said peripheral surface and continuing said movement until an amount of pressure has been applied that will cause said exterior elastomeric surface to deform to establish an interface contact area between said surfaces.

* * * * *